US010745181B2

(12) United States Patent
Duarte Da Cal et al.

(10) Patent No.: US 10,745,181 B2
(45) Date of Patent: Aug. 18, 2020

(54) PACKAGING FOR A TRANSPARENT LIQUID

(71) Applicant: SOCIÉTÉ ANONYME DES EAUX MINÉRALES D'EVIAN ET EN ABRÉGÉ "S.A.E.M.E", Evian les Bains (FR)

(72) Inventors: Germano Duarte Da Cal, Thonon-les-Bains (FR); Stéphane Mikolajczyk, Wittelsheim (FR)

(73) Assignee: SOCIÉTÉ ANONYME DES EAUX MINÉRALES D'EVIAN ET EN ABRÉGÉ "S.A.E.M.E", Évian-les-Bains (FR)

( * ) Notice: Subject to any disclaimer, the term of this patent is extended or adjusted under 35 U.S.C. 154(b) by 0 days.

(21) Appl. No.: 16/306,480

(22) PCT Filed: May 31, 2017

(86) PCT No.: PCT/FR2017/051357
§ 371 (c)(1),
(2) Date: Nov. 30, 2018

(87) PCT Pub. No.: WO2017/207923
PCT Pub. Date: Dec. 7, 2017

(65) Prior Publication Data

US 2019/0202611 A1 Jul. 4, 2019

(30) Foreign Application Priority Data

Jun. 1, 2016 (FR) ..... 16 54949
Dec. 30, 2016 (FR) ..... 16 63543

(51) Int. Cl.
*B65D 51/24* (2006.01)
*B65D 23/08* (2006.01)
(Continued)

(52) U.S. Cl.
CPC ..... *B65D 51/248* (2013.01); *A47G 19/2227* (2013.01); *B65D 23/0842* (2013.01);
(Continued)

(58) Field of Classification Search
CPC ..... A47G 2019/2238; A47G 2200/08; B65D 23/0842; B65D 2203/12; B65D 51/248;
(Continued)

(56) References Cited

U.S. PATENT DOCUMENTS 6,020,823 A 2/2000 DeCicco
6,254,247 B1 * 7/2001 Carson ..... A47G 19/2227 359/32

(Continued)

FOREIGN PATENT DOCUMENTS

FR 2912537 A1 8/2008
FR 2991752 A1 12/2013
WO WO 1989/06793 A1 7/1989

OTHER PUBLICATIONS

International Search Report for PCT/FR2017/051357 dated Aug. 25, 2017.

*Primary Examiner* — Peggy A Neils
(74) *Attorney, Agent, or Firm* — Arent Fox LLP

(57) ABSTRACT

Packaging comprising: a bottle at least partially transparent, a lighting system placed on the bottle in such a way as to emit a beam of light in a direction of lighting parallel to a central axis of the bottle, a covering film covering at least part of an exterior surface of a lateral wall of the bottle, the covering film comprising at least locally a decoration designed to be back-lit by the beam of light spreading through the liquid, the decoration comprising a plurality of decorative zones, each decorative zone having a degree of illumination, the plurality of decorative zones comprising at least one first contrast zone and at least one second contrast (Continued)

zone, the first contrast zone having a degree of illumination at least 5% lower than the degree of illumination of the second contrast zone.

17 Claims, 9 Drawing Sheets

(51) Int. Cl.
*A47G 19/22* (2006.01)
*F21V 33/00* (2006.01)

(52) U.S. Cl.
CPC .. *A47G 2019/2238* (2013.01); *B65D 2203/12* (2013.01); *F21V 33/0024* (2013.01)

(58) Field of Classification Search
CPC ..... B65D 2203/00; B65D 23/0807; F21V 33/0024; F21V 23/0414; F21L 13/06; F21L 4/00; F21L 13/04; F21L 4/08; G09F 23/06; G09F 2003/0273; H01M 10/44
See application file for complete search history.

(56) References Cited

U.S. PATENT DOCUMENTS

| | | | | |
|---|---|---|---|---|
| 7,762,682 | B2 * | 7/2010 | Yang | A47G 19/24 362/101 |
| 8,522,989 | B2 * | 9/2013 | Uptergrove | B41J 2/01 206/459.5 |
| 9,127,831 | B2 * | 9/2015 | Watanabe | F21L 13/06 |
| 10,215,396 | B2 * | 2/2019 | Willows | F21V 33/0004 |
| 2004/0004829 | A1 | 1/2004 | Policappelli | |
| 2008/0034628 | A1 | 2/2008 | Schnuckle | |
| 2014/0138274 | A1 | 5/2014 | Smith et al. | |
| 2014/0300273 | A1 * | 10/2014 | LeBrun | G09F 23/06 315/76 |
| 2017/0343206 | A1 * | 11/2017 | Hagen | A47G 19/00 |

* cited by examiner

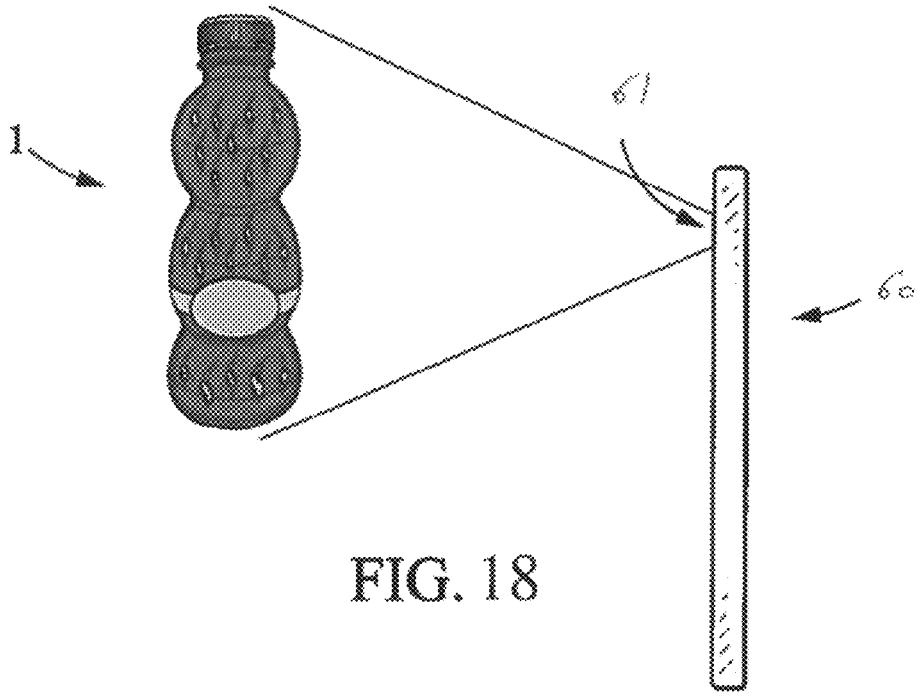
FIG. 18
FIG. 19
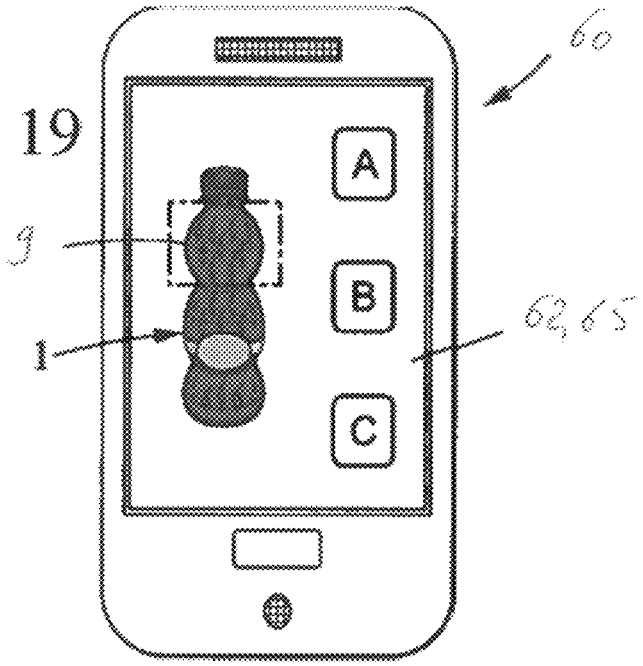

PACKAGING FOR A TRANSPARENT LIQUID

CROSS REFERENCE TO RELATED APPLICATIONS

This application is a 35 U.S.C. 371 National Phase of PCT Application No. PCT/FR2017/051357 filed May 31, 2017 which claims priority to FR Application No. 1654949, filed Jun. 1, 2016, and FR Application No. 1663543, filed Dec. 30, 2016, the disclosure of each of which is hereby incorporated by reference in their entirety.

FIELD OF THE DISCLOSURE

The invention relates to a packaging for a transparent liquid.

In particular, the invention relates to a packaging of the type comprising a bottle that is at least partly transparent, and a lighting system placed on the bottle so as to emit a light beam in a lighting direction parallel to a central axis of the bottle.

BACKGROUND OF THE DISCLOSURE

Known packagings of this type are used in order to highlight a bottle filled with a transparent liquid due to a visual effect produced by the propagation of the light beam in the transparent liquid.

However, the known packaging does not make it possible to modify the visual effect produced.

SUMMARY OF THE DISCLOSURE

The invention aims to overcome this drawback.

To this end, the invention proposes a packaging of the above-mentioned type also comprising a coating film covering at least a part of an outer surface of a side wall of the bottle, the coating film at least locally comprising a design capable of being backlit by the light beam propagating in the liquid, the design comprising a plurality of design areas, each design area having a light level defined by a ratio of an amount of light measured at a measuring distance from the lighting system through the design area to an amount of light measured directly at the measuring distance from the lighting system, the plurality of design areas comprising at least one first contrast area and at least one second contrast area, the first contrast area having a light level at least 15%, in particular at least 30%, preferably at least 40%, for example at least 50% less than the light level of the second contrast area.

Thus, the invention makes provision for an interaction between the light beam, the liquid, the design of the coating film, and, optionally, the bottle in order to produce a visual effect. It is thus possible to modify the visual effect by exploiting an arrangement of the first and second contrast areas, and, if appropriate, on a fill level of the bottle.

The first contrast area can be an opaque design area and the second contrast area can be a transparent design area, the opaque and transparent design areas having a difference in light level of at least 15%, in particular at least 30%, preferably at least 40%, for example at least 50%.

The coating film can comprise at least one window capable of allowing viewing of the side wall from the outside, the window forming one of the second contrast areas. In particular, the coating film can comprise a transparent portion forming said at least one window. In a complementary or alternative manner, the coating film can comprise a cutout forming said at least one window. The side wall of the bottle can comprise at least one transverse wall portion that is inclined with respect to the central axis, with provision then able to be made for the window on the transverse wall portion. The visual effect can thus result from the interaction of the light beam, the liquid and the design of the coating film with the shape of the bottle.

At least one of the first contrast areas can be an obscuring design area having a light level of less than 10%, preferably less than 5%. The obscuring design area can have a thickness that is less than 10 μm, preferably less than 5 μm, in particular less than 3 μm. For example, the obscuring design area can comprise a layer of metallic ink.

The design of the coating film can comprise first and second patterns superimposed, the coating film being capable of showing the first pattern when the design is not backlit by the light beam and of showing the second pattern when the design is backlit by the light beam. In particular, the coating film can have an inner surface that is in contact with the outer surface of the side wall of the bottle, and an outer surface opposite to the inner surface, the first of the two patterns being produced one on the inner surface of the coating film and the other on the outer surface of the coating film.

The coating film can have a lower edge situated at the level of the base of the bottle and an upper edge situated at the level of the neck of the bottle so as to substantially cover all of the outer surface of the side wall of the bottle. In particular, the bottle can have an initial fill level where it extends to a low point of a meniscus initially formed by a free surface of the liquid, the upper edge of the coating film being flush with the initial fill level.

The lighting system can comprise:

- an electric light source capable of emitting the light beam, and
- an independent electrical energy power supply device connected to the light source and having an active state in which said power supply device supplies the light source with electrical energy so as to emit the light beam, and an inactive state in which said power supply device does not supply the light source with electrical energy so as to not emit the light beam.

The power supply device can be capable of generating electrical energy from mechanical energy.

The lighting system can also comprise a control device connected to the power supply device and capable of switching the power supply device between the active state and the inactive state according to a timer.

The base of the bottle can have an inner surface delimiting the volume for receiving the liquid, and an outer surface, and the lighting system can be fixed on the outer surface of the base.

The lighting system can be a lighting component capable of emitting a light signal of a terminal such as a telephone or similar.

The terminal can also be equipped with an acquisition device capable of acquiring an image. The packaging can then be implemented in a method of presenting the bottle, the bottle having at least one optical feature selected from a pattern and a shape. The presentation method implementing:

- the terminal,
- a processing unit connected to the acquisition device and the lighting component of the terminal, the processing unit being capable of recognising, in an image acquired by the acquisition device, the optical feature of the bottle and of associating said optical feature with at least one item of multimedia content, the multimedia content comprising instructions that are readable by the processing unit in order to emit a light signal corresponding to the optical feature via the lighting component, the presentation method makes provision for the steps consisting of:

acquiring an image of the bottle via the acquisition device, recognising, in the image acquired by the acquisition device, the optical feature of the bottle and associating said optical feature with the multimedia content via the processing unit, emitting the light signal corresponding to the optical feature via the lighting component.

The presentation method can, after the optical feature has been associated with an item of multimedia content, make provision for placing the terminal close to the bottle and orienting the lighting component towards the volume of the bottle.

The presentation method can, after the optical feature has been associated with an item of multimedia content, make provision for the steps consisting of:

placing the terminal on a support surface so that the lighting component emits the light signal in a direction opposite to the support surface, and placing the base of the bottle on the lighting component.

The coating film can have a pattern as an optical feature, the presentation method making provision for backlighting the pattern when the light signal is emitted.

The side wall of the bottle can have the shape as an optical feature. In particular, the side wall of the bottle can comprise at least one bulge between two narrow parts, the bulge having a maximum transverse dimension greater than at least 20%, to a maximum transverse dimension of each of the narrow parts, said at least one bulge forming the shape.

The light signal can have a predefined rhythm for a light display.

The light signal can comprise at least one light beam emitted in a direction of illumination.

The lighting component can comprise a flash lamp suitable for an acquisition of an image by the acquisition device under low light conditions.

The lighting component can comprise a display screen.

The processing unit can comprise a database storing a plurality of optical features and a plurality of items of multimedia content, each associated with an optical feature.

The processing unit can comprise a processor and a memory arranged in the terminal, the database being stored in the memory.

As a variant, the processing unit can comprise:

a remote server in which the database is stored, and a processor and a communication interface arranged in the terminal, the communication interface being capable of communicating with the remote server.

The terminal can be equipped with at least one sound component capable of emitting a sound signal and in which the multimedia content comprising instructions that are readable by the processing unit in order to emit a sound signal corresponding to the optical feature via the sound component.

The sound signal and the light signal can be emitted in synchronization.

The processing unit can comprise at least one recording device capable of recording a voice message as sound signal, the presentation method making provision for emitting the recorded voice message.

The terminal can be capable of being carried in the hand of a user.

BRIEF DESCRIPTION OF THE DRAWINGS

Further aims and advantages of the invention will become apparent on reading the following description of particular non-limitative embodiments of the invention, the description being given with reference to the attached drawings in which:

FIG. 18 is a diagrammatic representation of a step of a method of presenting the bottle consisting of acquiring an image of the bottle via the acquisition device equipping the terminal, FIG. 19 is a diagrammatic representation of a step of the presentation method consisting of recognising, in the image acquired by the acquisition device, an optical feature of the bottle selected from a pattern and a shape and associating the optical feature with an item of multimedia content via the processing unit, in order to emit in particular the light signal corresponding to the optical feature via the lighting component.

DETAILED DESCRIPTION

Figure 1:
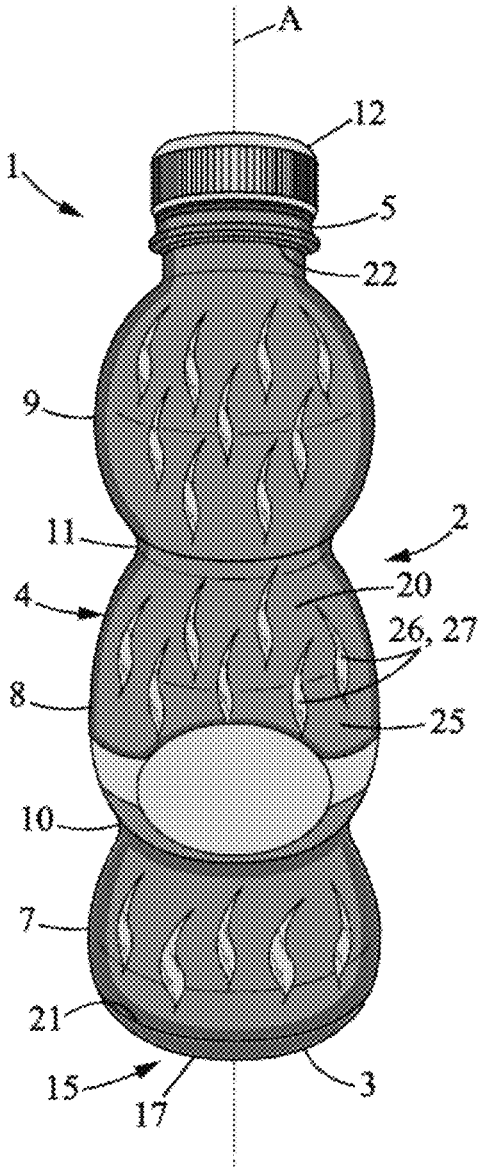
FIG. 1 is a representation of a packaging according to a first embodiment, the packaging comprising a bottle, a coating film covering an outer surface of a side wall of the bottle and a lighting system capable of emitting a light beam along a central axis of the bottle, the coating film comprising a design comprising first and second contrast areas in the form of opaque and transparent design areas respectively, the lighting system being switched off, FIG. 2 being a representation of the packaging in FIG. 1, showing the lighting system lit and the light beam propagating in the transparent liquid comprised in the bottle for backlighting the design of the coating film.

In the figures, the same references denote identical or similar elements.

FIGS. 1 to 3 and 6 show a packaging 1 according to a first embodiment of the invention.

The packaging 1 comprises a bottle 2 internally comprising an volume for receiving a transparent liquid. Within the meaning of the present application, by "a transparent liquid" is meant a liquid having a light level greater than 70%, the light level being defined by a ratio of an amount of light measured at a measuring distance from a light source 16 though a liquid height to an amount of light measured directly at the measuring distance from the light source 16. The transparent liquid can in particular be a drink and, in particular, water, in particular spring water, for example still or sparkling.

The bottle 2 is transparent, completely or partially, i.e. it has a light level greater than 70%, the light level then being defined by a ratio of an amount of light measured at a measuring distance from the light source 16 through the bottle to an amount of light measured directly at the measuring distance from the light source 16. In the embodiment shown, without being limited thereby, the bottle 2 is disposable and produced from plastic material such as PET. As a variant, the bottle 2 can be produced from any other suitable material and in particular from glass.

The bottle 2 has a central axis A and comprises a base 3 that is transverse overall with respect to the central axis A. The base 3 has an outer surface on which a support surface is arranged, and an inner surface delimiting the volume for receiving the liquid. The bottle 2 also comprises a side wall 4 which extends from the base 3 around the central axis A up to a neck 5 delimiting an upper opening 6 opposite to the base 3. The side wall 4 has an inner surface delimiting the volume for receiving the liquid, and an outer surface opposite to the inner surface. In the embodiment shown, without being limited thereby, the side wall 4 has a succession of three bulges 7, 8, 9 that are substantially spherical: a lower bulge 7 in the vicinity of the base 3, an intermediate bulge 8 separated from the lower bulge 7 by a first narrow part 10 and an upper bulge 9 in the vicinity of the neck 5 and separated from the intermediate bulge 8 by a second narrow part 11. The bulges 7, 8, 9 form transverse wall portions that are inclined relative to the central axis A:

- between the base 3 and a middle part of the lower bulge 7,
- between the middle part of the lower bulge 7 and the first narrow part 10,
- between the first narrow part 10 and a middle part of the intermediate bulge 8,
- between the middle part of the intermediate bulge 8 and the second narrow part 11,
- between the second narrow part 11 and a middle part of the upper bulge 9,
- between the middle part of the upper bulge 9 and the neck 5.

Provision can be made for a cap 12 on the neck 5 in order to reversibly seal the upper opening 6. In the embodiment shown, the cap 12 can be mounted in a detachable manner, for example by screwing, on the neck 5. As a variant, the cap can be mounted and remain on the neck 5 and comprise a movable part that can be moved between a sealing position in which it seals the upper opening 6 and an opening position in which it is separated from the upper opening 6.

The packaging 1 also comprises a lighting system 15 comprising an electrical light source, such as one or more LEDs 16, capable of emitting a light beam, and an independent electrical energy power supply device, comprising for example a battery and a switch. The battery is connected to the LEDs 16 via the switch in order to, in an active state, supply the LEDs 16 with electrical energy so as to emit the light beam, and in an inactive state, to not supply the LEDs 16 with electrical energy so as to not emit the light beam. In the embodiment shown, the LEDs 16 and the power supply device are mounted on a flat support 17 that is for example circular having a diameter less than the diameter of the base 3 of the bottle 2. The LEDs 16 are mounted on one and the same face of the support 17. The lighting system 15 is placed on the bottle 2 with the face on which the LEDs 16 are mounted against the outer surface of the base 3 so as to emit the light beam in a lighting direction parallel to the central axis A of the bottle 2. The support 17 can be firmly attached to the outer surface of the base 3 of the bottle, for example by means of a layer of adhesive material 18.

The packaging 1 also comprises a coating film 20 covering the outer surface of the side wall 4 of the bottle 2. In the embodiment shown, the coating film 20 has a lower edge 21 situated at the level of the base 3 of the bottle 2 and an upper edge 22 situated at the level of the neck 5 of the bottle 2 so as to substantially cover all of the outer surface of the side wall 4 of the bottle 2. In particular, the bottle 2 has an initial fill level where it extends to a low point of a meniscus initially formed by a free surface of the liquid. The upper edge 22 of the coating film 20 is thus flush with the initial fill level. As a variant, only a part of the outer surface of the side wall 4 of the bottle 2 may be covered by the coating film 20.

The coating film 20 comprises a design having several design areas 25, 26. Each design area 25, 26 has a light level defined by a ratio of an amount of light measured at a measuring distance D from the light source 16 through the design area to an amount of light measured directly at the measuring distance from the light source 16. The design is constituted by a particular arrangement of one or more first contrast areas 25 and one or more second contrast areas 26. In the embodiment shown, the coating film comprises several second contrast areas 26 in the shape of separate flames, and first contrast areas 25. The first contrast areas 25 have a light level at least 15%, in particular at least 30%, preferably at least 40%, for example at least 50% less than the light level of the second contrast areas 26.

In the particular embodiment shown, the first contrast areas are opaque design areas 25 and the second contrast areas are transparent design areas 26. The opaque 25 and transparent 26 design areas have a difference in light level of at least 15%, in particular at least 30%, preferably at least 40%, for example at least 50%. As a variant, the first and second contrast areas may be produced in any manner suitable for obtaining a contrast. The first and second contrast areas may in particular be more or less translucent, more or less coloured, more or less thick, etc.

Figure 4:
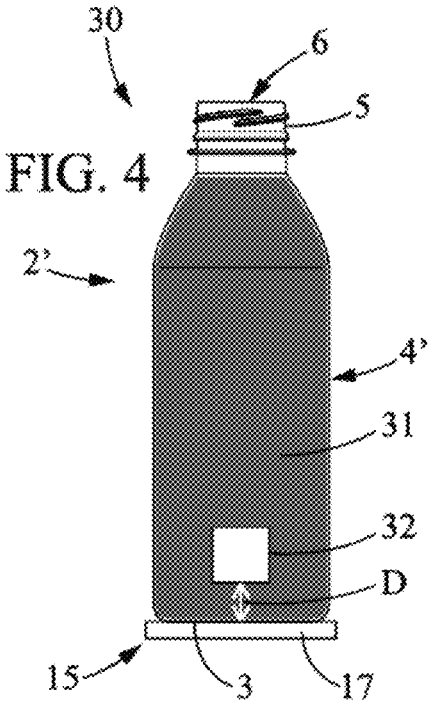
FIG. 4 is a front view of an experimental device for measuring a light level in a design area.
Figure 5:
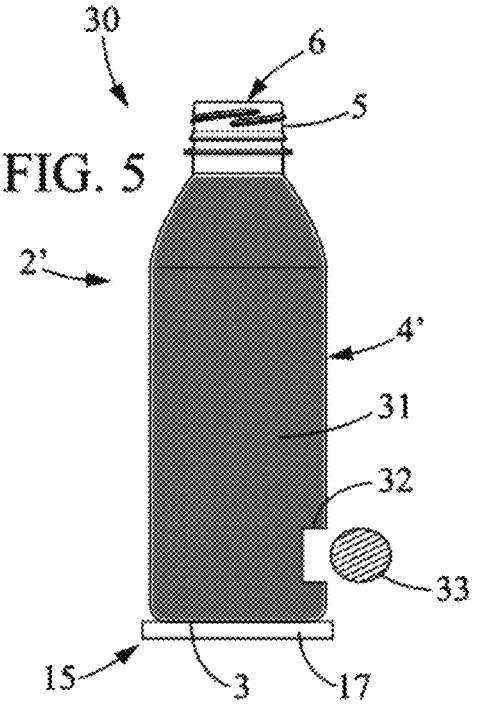
FIG. 5 is a side view of the experimental device in FIG. 4.

By way of a non-limitative example, FIGS. 4 and 5 show an experimental device 30 utilized in order to measure a light level of different design areas. A mask 31 covers the side surface 4' of a bottle 2' that is cylindrical overall along the central axis A. The mask 31 is essentially opaque with the exception of an opening 32, visible in FIGS. 4 and 5, situated at the measuring distance D, for example 2 cm, from the support face 17 on which the LEDs are placed. A sensor 33 capable of measuring an amount of light, for example of the type Luxmeter MS-200LED commercialized by the company VOLTCRAFT, is placed facing the opening 32 and connected to a processing unit.

An initial measurement of the amount of light at the measuring distance D is carried out directly through the opening 32. The different design areas are then successively placed in the opening 32 and the amount of light at the measuring distance D is measured through each of the design areas.

The results obtained are shown in the table below.

TABLE

| Design area | Lighting (lux) | Light level |
|---|---|---|
| None | 19.5 ± 0.6% | 100% |
| Blue | 3.1 ± 0.1% | 15.9% |
| Red | 1.4 ± 0.1% | 7.2% |
| Green | 3.3 ± 0.1% | 16.9% |
| White | 12.1 ± 0.4% | 62.1% |
| Black | 0.2 ± 0.1% | 1.0% |
| Brown | 0.6 ± 0.1% | 3.1% |
| Light brown | 4.1 ± 0.2% | 21.0% |
| Transparent | 15.3 ± 0.5% | 78.5% |

Thus, a difference in the light level of the order of 15% can correspond to a design having black opaque design areas and blue or green transparent design areas. A difference in the light level between 40% and 50% can correspond to a design having blue or green opaque design areas and white transparent design areas.

Figure 2:
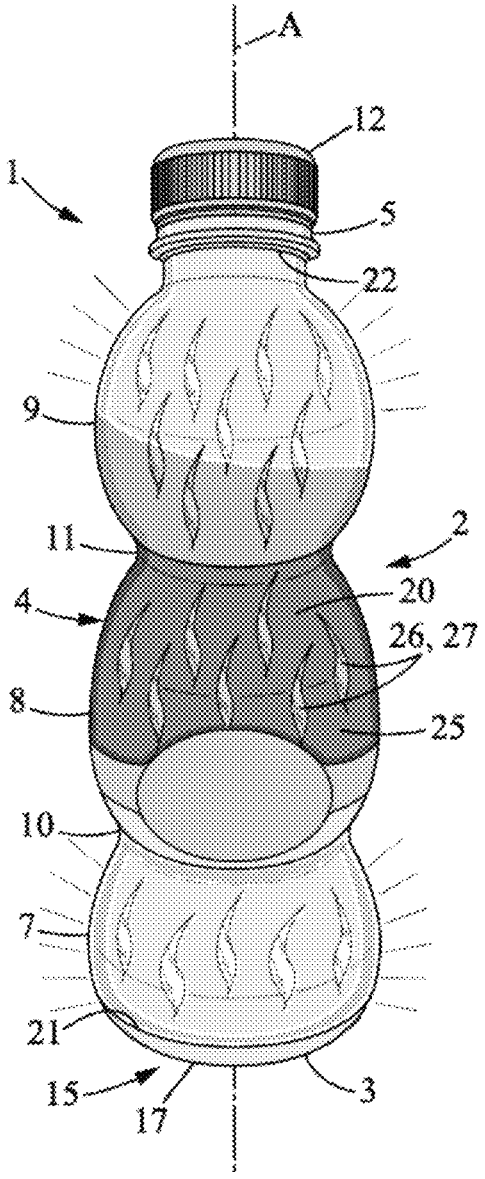
Figure 3:
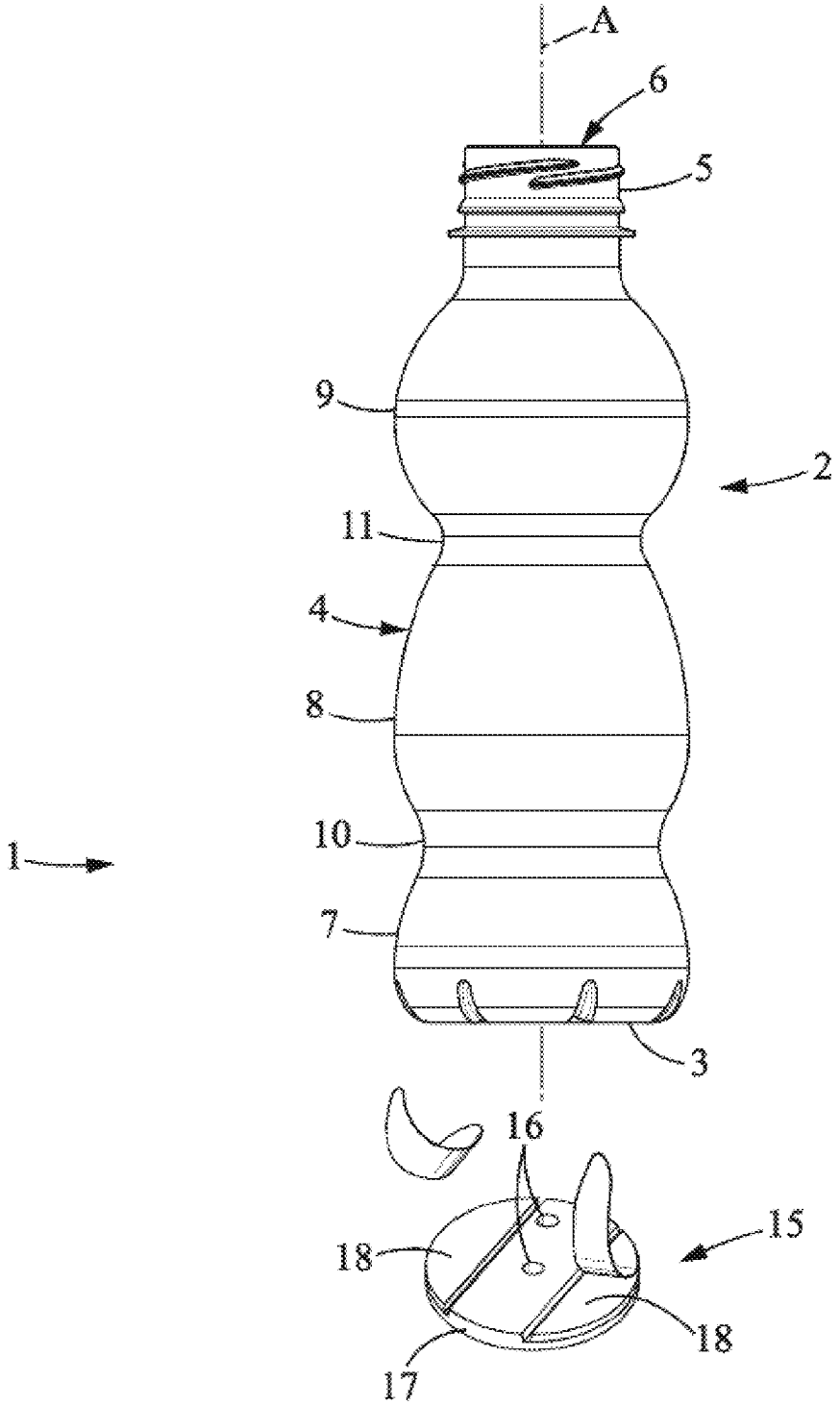
FIG. 3 is a partially exploded view of the packaging in FIG. 1, showing the lighting system equipped with an electric light source and an independent electrical energy power supply device mounted on a support that is firmly fixed to an outer surface of a base of the bottle.

In FIGS. 1 and 2, each transparent design area 26 can be constituted by a window 27 capable of allowing viewing of the side wall 4 from outside. The window 27 then has a light level greater than 70%. Each window 27 can be obtained by a portion of transparent film. The remainder of the coating film comprising the opaque design areas 25 has a light level at least 15% less than that of the transparent design areas 26. The opaque design areas 25 can then be black or coloured, and, for example, blue, red and/or green. As a variant, each window 27 may be formed by a cutout arranged in the coating film 20.

Moreover, in order to obtain the desired opacity and, if appropriate, to vary it, it is possible to vary different parameters of the coating film 20 such as for example: the thickness of the coating film, the thickness or number of printed layers forming the design on the coating film 20, the amount of ink used in the printed layer. In particular, one or more of the opaque design areas 25 may be an obscuring design area having a light level of less than 10%, preferably less than 5%. The obscuring design area is preferably thin, with a thickness that is less than 10 μm, preferably less than 5 μm, in particular less than 3 μm. For example, the obscuring design area comprises a layer of metallic ink. The opaque design area 25 can then be reflective, so as to channel the light towards the transparent design areas 26. Such an effect may be obtained by distributing metallic particles over a printed layer. According to other variants, as is shown in the table above, the transparent design areas 26 may be green or blue and the opaque design areas 25 may have a light level at least 15% less than that of the transparent design areas 26, i.e. they are black. Or also, the transparent design areas 26 may be white and the opaque design areas 25 may have a light level at least 40% less than that of the transparent design areas 26, i.e. they are blue or green.

In FIG. 1, the lighting system 15 is switched off. In contrast, in FIG. 2, the lighting system 15 is lit, such that the light beam emitted by the LEDs 16 supplied with electrical power by the battery propagate in the liquid in order to backlight the design of the coating film 20. The difference in lighting between the first and second contrast areas makes it possible to obtain a particular visual effect that depends on the arrangement of the different contrast areas. Moreover, the lower bulge 7, close to the light source 16, is lit more intensely than the intermediate bulge 8. As a result of the propagation of the light beam in the liquid that fills the bottle in FIG. 2 and the reflection on the meniscus of the free surface of the liquid, the upper bulge 9 is also lit more intensely than the intermediate bulge 8.

Thus, the light beam, the liquid, the design of the coating film 20 and the bottle 2, in particular by means of its shape, interact in order to produce a visual effect that it is then possible to modify by exploiting an arrangement of the first and second contrast areas.

Figure 6:
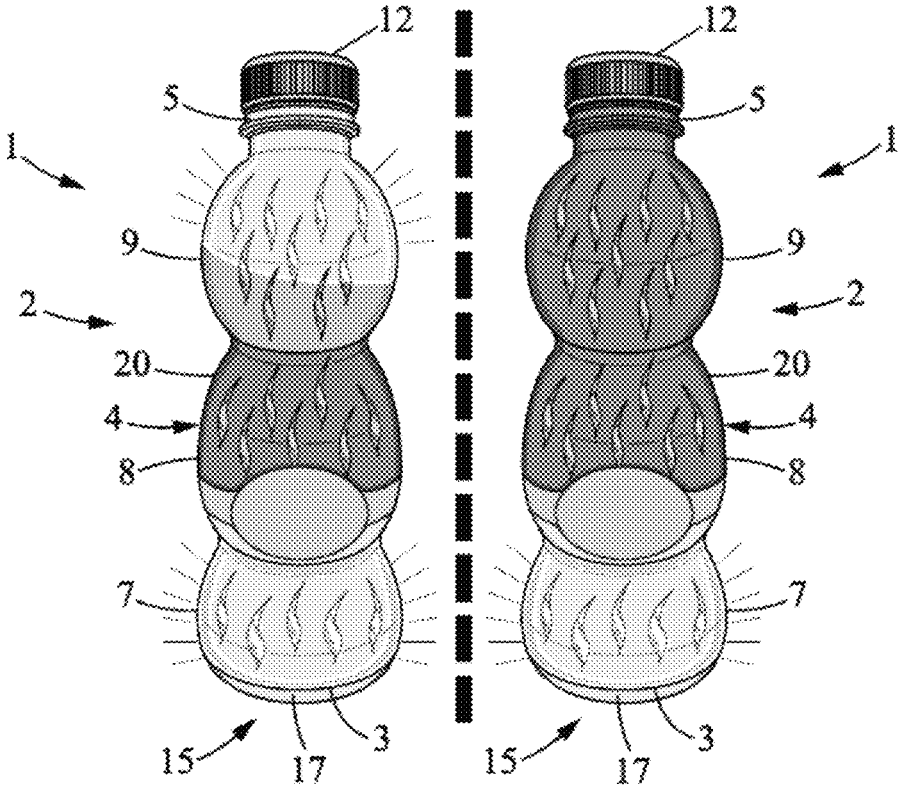
FIG. 6 is a representation of the packaging in FIG. 1, showing the lighting system lit when the bottle is filled with transparent liquid, on the left, and when the bottle is empty, on the right.
Figure 7:
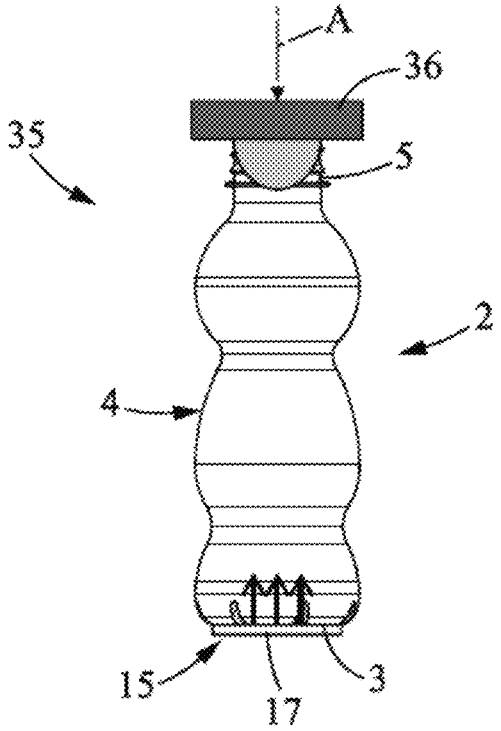
FIG. 7 is a representation of an experimental device for measuring lighting as a function of the fill level of the bottle.
Figure 8:
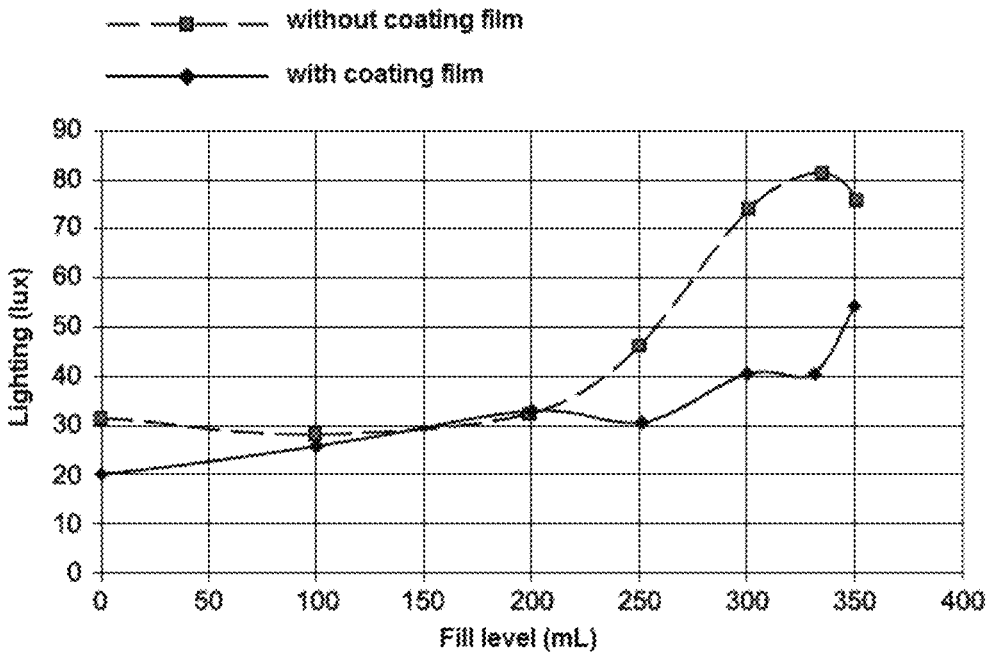
FIG. 8 is a graph resulting from implementation of the experimental device in FIG. 7, showing a change in the lighting as a function of the fill level of the bottle, when the bottle is without a coating film and when the bottle is covered with a coating film.

As is apparent in FIGS. 6 to 8, the visual effect can also be modified by exploiting the fill level of the bottle 2.

FIG. 6 shows, on the left, the packaging 1 described above in the configuration of FIG. 2, i.e. with the bottle 2 full up to the initial fill level, and the lighting system 15 lit. On the right, in contrast, the bottle 2 is empty, the lighting system 15 remaining lit. When the bottle is empty, only the lower bulge 7, close to the light source 16, is lit more intensely than the remainder of the bottle 2.

The modification of the visual effect is shown in FIGS. 6 and 7 with an experimental device 35 for measuring the lighting as a function of the fill level of the bottle 2. A sensor 36, for example of the type Luxmeter MS-200LED commercialized by the company VOLTCRAFT, is placed on the neck 5 of the bottle 2, in the upper opening 6, in order to measure the amount of light originating from the light beam through different fill levels of the bottle 2. The sensor 36 is connected to a processing unit. The measurements are taken with and without coating film. As is apparent in FIG. 8 showing the change in lighting as a function of the fill level of the bottle 2, the lighting at the level of the sensor 36 increases with the fill level of the bottle 2. The change in the lighting is, furthermore, more progressive with a coating film 20 that without coating film.

Figure 9:
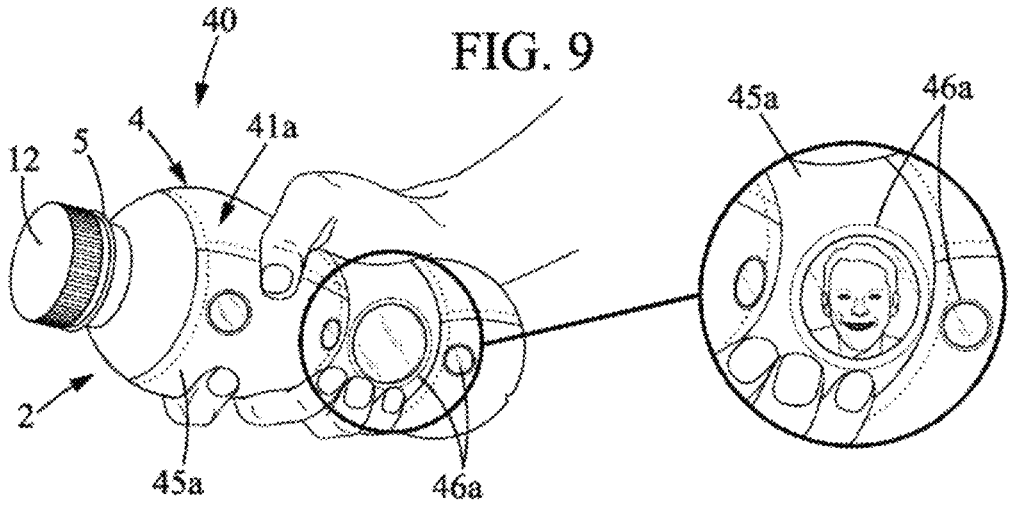
FIG. 9 is a representation of a packaging according to a second embodiment of the invention, showing a design of the coating film comprising first and second patterns superimposed, the first pattern being visible when the design is not backlit and the second pattern being visible when the design is backlit.
Figure 10:
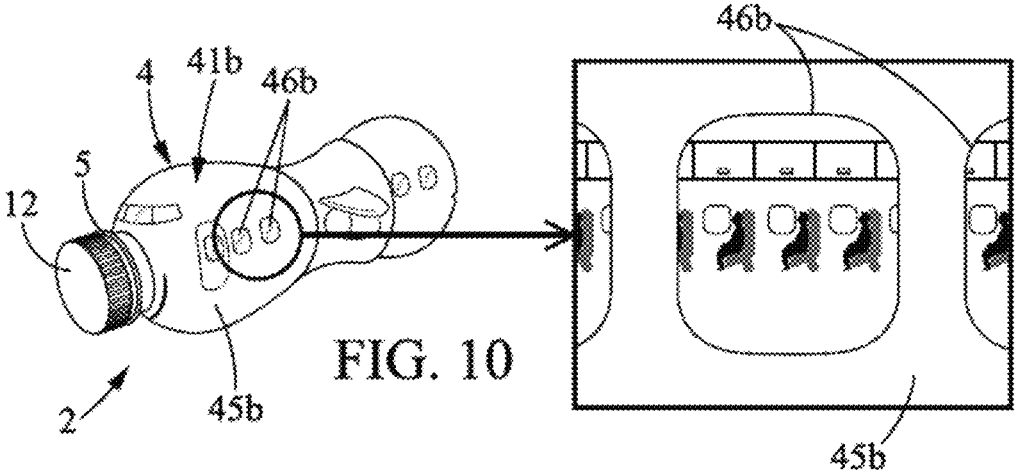
FIG. 10 is a representation of a variant of the packaging in FIG. 9.

FIGS. 9 and 10 show variants of a packaging 40 according to a second embodiment of the invention. The packaging 40 according to the second embodiment differs from the first embodiment described previously only by the design of the coating film 41*a*, 41*b*. The description will therefore not be repeated in detail, and for further details reference may be made to the description of the packaging that has already been given.

In FIG. 9, the design comprises opaque design areas 45*a* featuring a body and transparent design areas 46*a* featuring windows. At least one of the transparent design areas 46*a* comprises first and second patterns superimposed such that the first pattern masks the second pattern when the design is not backlit by the light beam and the second pattern can be seen when the design is backlit by the light beam. For example, the first pattern can be a white colour filling the window when the lighting system 15 is switched off and the second pattern can be a face visible in the window when the lighting system 15 is lit.

As a variant, in FIG. 10, the design comprises opaque design areas 45*b* featuring an aircraft cabin and transparent design areas 46*b* also featuring windows. The first pattern can be a white colour filling the window when the lighting system 15 is switched off and the second pattern can be a representation of rows of seats inside the aircraft visible in the window when the lighting system 15 is lit.

To this end, the first and second patterns can be produced, one on an inner surface of the coating film 41, 42 in contact with the outer surface of the side wall 4 of the bottle 2, and the other on an outer surface of the coating film 41, 42 opposite to the inner surface.

Figure 11:
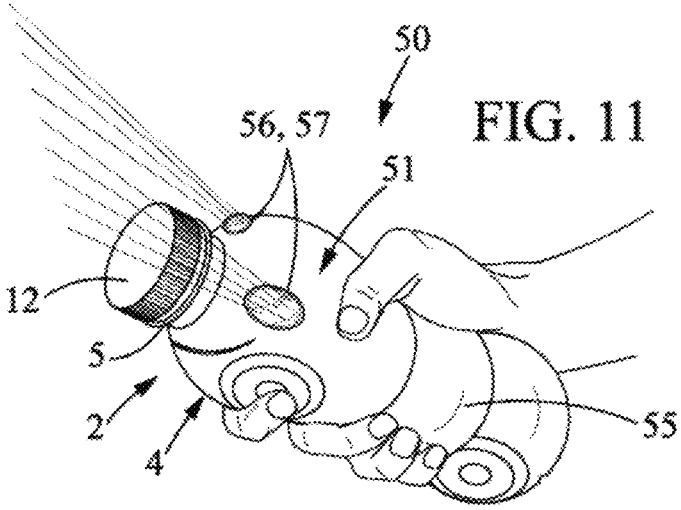
FIG. 11 is a representation of a packaging according to a third embodiment of the invention, showing a coating film comprising two windows forming two transparent design areas for which provision is made respectively on a transverse wall portion of the side wall.

FIG. 11 shows a packaging 50 according to a third embodiment of the invention, which once again differs from the first embodiment described previously only by the design of the coating film 51. The description will therefore not be repeated in detail, and for further details reference may be made to the description of the packaging that has already been given.

The design comprises opaque design areas 55 featuring a car body and transparent design areas 56 featuring headlights. The transparent design areas 56 can be produced by windows 57 obtained by portions of transparent film or cutouts arranged in the coating film 51. Provision is then made for the windows 57 on the transverse wall portion of the upper bulge 9 of the side wall 4. As the windows 57 are thus orientated substantially transversally with respect to the light beam, they can provide more intense lighting than the remainder of the bottle 2 when the lighting system 15 is lit. The opaque design areas 55 can also be selected in order to channel the light beam and concentrate it towards the windows 57.

Figure 12:
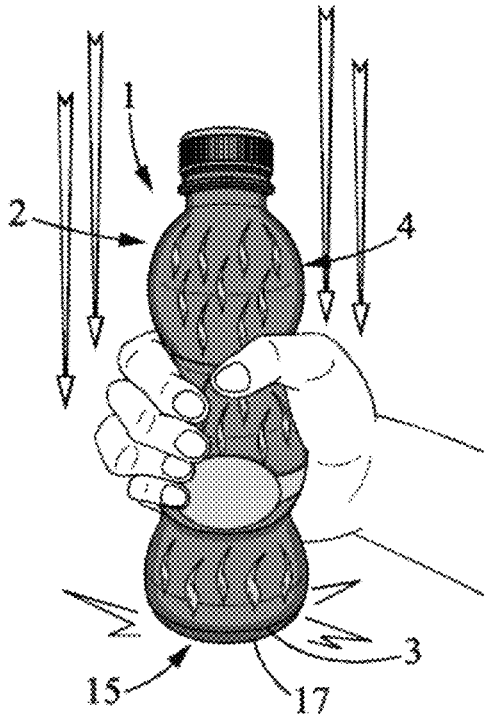
FIG. 12 is a representation of a variant of the packaging in FIG. 1, showing an activation of the electrical energy power supply device of the lighting system via an impact.
Figure 13:
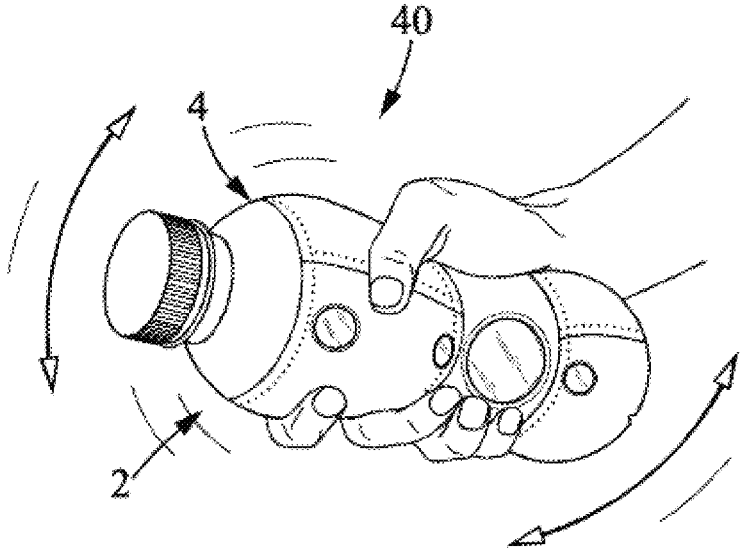
FIG. 13 is a representation of a variant of the packaging in FIG. 9, showing an activation of the electrical energy power supply device of the lighting system by shaking.

FIGS. 12 and 13 show variants of the packaging 1, 40 of the first and second embodiments shown in FIGS. 1 and 9. In these variants, the battery and the switch of the power supply device are replaced by a power supply device capable of generating electrical energy from mechanical energy. In particular, in FIG. 8, the power supply device can be activated by an impact on the base 3 of the bottle 4. In FIG. 9, the power supply device can be activated by shaking the bottle 2.

In other embodiments, activation of the power supply and lighting device of the bottle 2 and of the coating film 20, 41*a* may be controlled in any suitable manner. For example, a control device can be connected to the power supply device in order to make it switch between the active state and the inactive state according to a determined sequence defined in particular by a timer.

Figure 14:
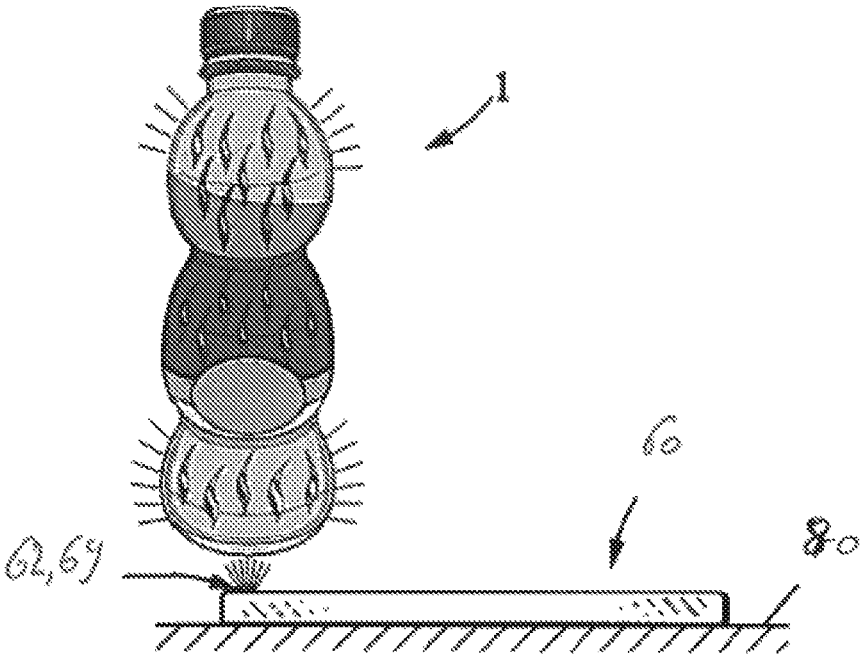
FIG. 14 is a diagrammatic representation of a packaging according to a fourth embodiment of the invention, in which the lighting system is a lighting component of a terminal.

In a fourth embodiment shown in FIG. 14, the lighting system can be a lighting component 62 of a terminal 60 such as a telephone or similar. The terminal 60 is placed close to the bottle 2, for example below it, by orienting the lighting component 62 towards the volume of the bottle 2, for example through the base 3, in order to illuminate the content thereof.

Figure 15:
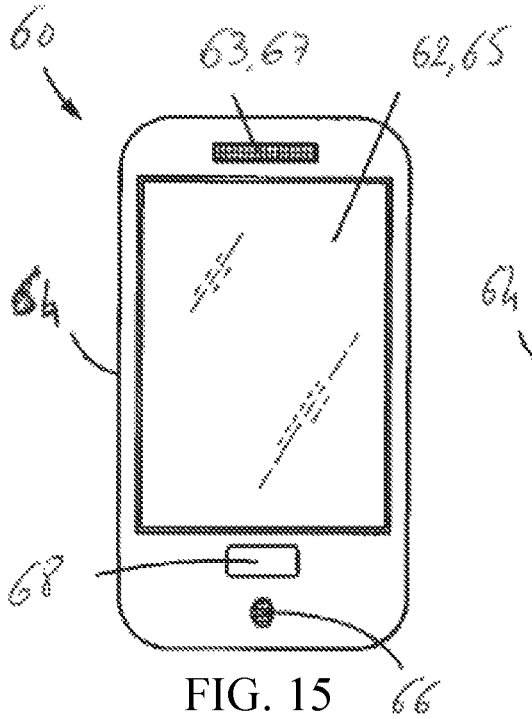
FIGS. 15 and 16 are diagrammatic representations of front and rear faces respectively of the terminal in FIG. 14, plus the lighting component capable of emitting a light signal, the terminal being equipped with an acquisition device capable of acquiring an image.
Figure 16:
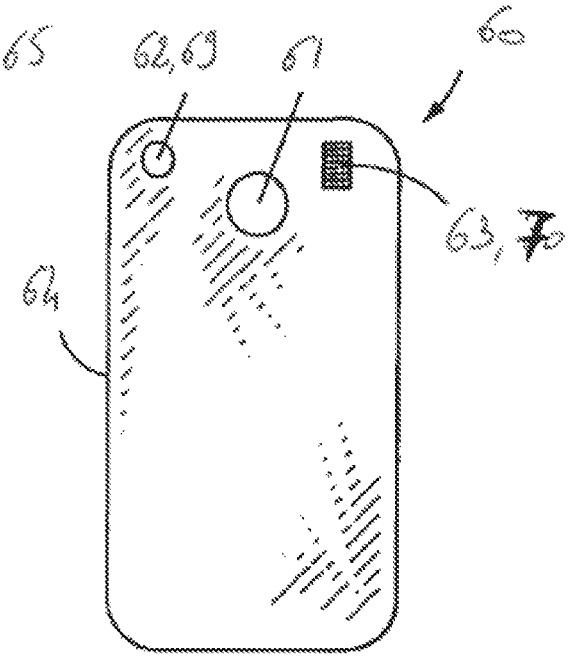

Apart from the lighting component 62 capable of emitting a light signal, the terminal 60 can be equipped with a acquisition device 61 capable of acquiring an image and a sound component 63 capable of emitting a sound signal. The terminal 60 can form part of an electronic system shown in FIGS. 15 to 17, also comprising a processing unit capable of recognising, in an image acquired by the acquisition device 61, at least one optical feature of the bottle 2 and of associating said optical feature with at least one item of multimedia content.

In the embodiment shown, the optical feature can be at least one of the pattern on the coating film 20 and the shape of the bottle 2. As a variant, the optical feature may be constituted by any other pattern comprising areas that differ from one another by one or more optical parameters, visible by a user or at least detectable by a suitable detection device, such as a colour, a contrast, an intensity or a light level. The optical feature may also be constituted by any other form.

The multimedia content comprises instructions that are readable by the processing unit in order to emit a light signal corresponding to the optical feature via the lighting component 61. The light signal can comprise one or more lights of different colours and/or intensities emitted at a predefined rhythm for a light show. When the terminal 60 is equipped with a sound component 23, the multimedia content can also comprise instructions that are readable via the processing unit in order to emit a sound signal corresponding to the optical feature via the sound component 63. The sound signal can comprise one or more sounds of different levels and/or intensities, if appropriate, emitted in synchronization with the light signal.

The terminal 60 comprises a case 64 that can be carried in the hand of a user and contains a set of electronic components. In particular, in FIGS. 15 and 16, the terminal 60 is a telephone comprising on a front face a display screen 65, optionally a touch screen, a microphone 66, a loudspeaker 67 and one or more control function keys 68. On a rear face, the terminal 60 comprises a lens of the lighting device 61, a flash lamp 69 suitable for the acquisition of an image by the acquisition device under low light conditions and another loudspeaker 70. The display screen 65 and the flash lamp 69 can serve the lighting component 62, the first for emitting a light signal in the form of a more or less diffuse illuminated surface and the second for emitting a light signal in the form of a light beam that is more or less focussed in a direction of illumination. The loudspeakers 67, 70 of the front and rear faces can serve as sound component 63.

Figure 17:
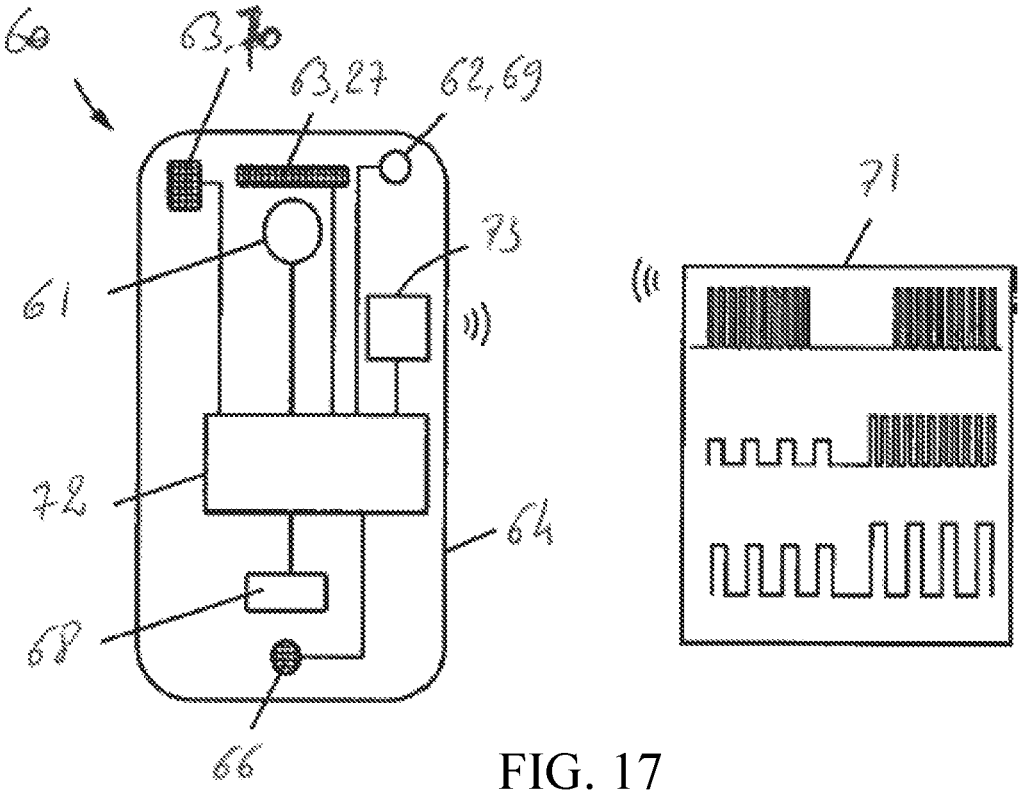
FIG. 17 is a diagrammatic representation of a processing unit comprising a remote server in which is stored a database storing a plurality of optical features of the bottle and a plurality of items of multimedia content, each associated with an optical feature, the processing unit also comprising a processor and a communication interface arranged in the terminal, the communication interface being capable of communicating with the remote server.

In FIG. 17, the processing unit comprises a remote server 71 in which is stored a database storing a plurality of optical features of bottles and a plurality of items of multimedia content, each associated with an optical feature. The processing unit also comprises a processor 72 and a communication interface 73 both mounted in the case 64 of the terminal 60. The communication interface 73 is capable of communicating, preferably remotely according to any suitable protocol but optionally by a wired connection, with remote networks and, in particular, with the server 71. The processor 72 is connected to the acquisition device 61, to the lighting components 62, namely the display screen 65 and the flash lamp 69, the sound components 63, namely the loudspeakers 67, 70 of the front and rear faces, the microphone 66, the control function keys 68 and the communication interface 73. The processor 72 is capable of recognising, in the image acquired by the acquisition device 61, the optical feature of the bottle 1 and of associating this optical feature with at least one item of multimedia content obtained from the database stored on the server 71 by the communication interface 73.

As a variant, the processing unit can be completely contained within the terminal 60. Apart from the processor 72, the processing unit then comprises a memory in which the database is stored.

With reference to FIGS. 18 and 19, a method for the presentation of the bottle 2 utilizing the terminal 60 and the processing unit is described.

An image of the bottle 2 is acquired via the acquisition device 61 of the terminal 60 and transmitted to the processor 72.

The optical feature of the bottle 2, for example the upper bulge 9, is recognized by the processor 72 in the image acquired by the acquisition device 61. The processor 72 communicates with the server 71 via the communication interface 73 in order to associate the corresponding multimedia content with the optical feature. A page offering the user different choices can then be displayed on the display screen 65 of the terminal 60. Among the choices offered, A, B or C in FIG. 19, one can relate to the sound signal to be selected from a piece of music, a song or a voice message, in particular a story, that is pre-recorded or downloaded. The sound signal can also be a voice message recorded prior to its reproduction by a recording device of the processing unit comprising, in the embodiment shown, the microphone 66 of the terminal 60 and a memory. In the case of a telephone, the sound signal can also be a voice message recorded on a remote messaging service. The user can then decide to read the multimedia content by selecting one of the choices offered.

The processor 72 can then control the illumination 62 and sound 63 component or components according to the instructions of the multimedia content in order to deliver the corresponding light and sound signals.

The front face of the terminal 60 can be placed on a support surface 80 in such a way that the flash lamp 69 emits the light signal in a direction opposite to the support surface 80. The base 3 of the bottle 2 can then be placed on the flash lamp 69 in such a way that the light signal corresponding to the optical feature is emitted substantially along the central axis A of the bottle 2 in synchronization with the sound signal, the pattern of the coating film 20 being backlit.

The invention claimed is:

1. Packaging for a transparent liquid comprising a bottle that is at least partly transparent internally comprising a volume for receiving the liquid, and a lighting system capable of emitting a light beam, the bottle having an initial fill level where it extends to low point of a meniscus initially formed by a free surface of the liquid, wherein the bottle has a central axis and comprises:

a base having a support surface that is transverse relative to the central axis, the base of the bottle having an inner surface delimiting the volume for receiving the liquid, and an outer surface, a side wall which extends from the base around the central axis, the side wall having an inner surface delimiting the volume for receiving the liquid, and an outer surface, a neck delimiting an upper opening opposite to the base, and a cap capable of being mounted on the neck in order to reversibly seal the upper opening, and wherein the lighting system is placed on the bottle so as to emit the light beam in a lighting direction parallel to the central axis of the bottle, in order for the light beam to propagate in the liquid, the lighting system being fixed on the outer surface of the base, wherein the packaging also comprises a coating film covering at least a part of the outer surface of the side wall of the bottle, the coating film at least locally comprising a design capable of being backlit by the light beam propagating in the liquid, the design comprising a plurality of design areas, each design area having a light level defined by a ratio of a quantity of light measured at a measuring distance from the lighting system through the design area to a quantity of light measured directly at the measuring distance from the lighting system, the plurality of design areas comprising at least one first contrast area and at least one second contrast area, the first contrast area having a light level at least 50% less than the light level of the second contrast area, wherein the first contrast area is an opaque design area and the second contrast area is a transparent design area, the opaque and transparent design areas having a difference in light level of at least 50%, wherein at least one of the first contrast areas is an obscuring design area having a light level less than 10%, wherein the coating film has a lower edge situated at the level of the base of the bottle and an upper edge situated at the level of the neck of the bottle so as to cover all of the outer surface of the side wall of the bottle, the upper edge of the coating film flushing with the initial fill level.

2. Packaging according to claim 1, wherein the coating film comprises at least one window capable of allowing viewing of the side wall from the outside, the window forming one of the second contrast areas.

3. Packaging according to claim 2, wherein the coating film comprises a transparent portion forming said at least one window.

4. Packaging according to claim 2, wherein the coating film comprises a cutout forming said at least one window.

5. Packaging according to claim 2, wherein the side wall of the bottle comprises at least one transverse wall portion that is inclined relative to the central axis, provision being made for the window on the transverse wall portion.

6. Packaging according to claim 1, wherein the obscuring design area has a thickness less than 10 μm, preferably less than 5 μm, in particular less than 3 μm.

7. Packaging according to any one of claim 1, wherein the obscuring design area comprises a layer of metallic ink.

8. Packaging according to claim 1, wherein the design of the coating film comprises first and second patterns superimposed, the coating film being capable of showing the first pattern when the design is not backlit by the light beam and of showing the second pattern when the design is backlit by the light beam.

9. Packaging according to claim 8, wherein the coating film has an inner surface that is in contact with the outer surface of the side wall of the bottle, and an outer surface opposite to the inner surface, the first and second patterns being produced one on the inner surface of the coating film and the other on the outer surface of the coating film.

10. Packaging according to claim 1, wherein the lighting system comprises:

an electric light source capable of emitting the light beam, and an independent electrical energy power supply device connected to the light source and having an active state in which said power supply device supplies the light source with electrical energy so as to emit the light beam, and in inactive state in which said power supply device does not supply the light source with electrical energy so as to not emit the light beam.

11. Packaging according to claim 10, wherein the power supply device is capable of generating electrical energy from mechanical energy.

12. Packaging according to claim 10, wherein the lighting system also comprises a control device connected to the power supply device and capable of switching the power supply device between the active state and the inactive state according to a timer.

13. Packaging according to claim 1, wherein the obscuring design area has a light level less than 5%.

14. Packaging according to claim 1, wherein the obscuring design area has a thickness less than 5 μm.

15. Packaging according to claim 1, wherein the obscuring design area has a thickness less than 3 μm.

16. The packaging according to claim 1, wherein the bottle further comprises an upper bulge and an intermediate bulge that is closer to the lighting system than the upper bulge, and wherein the coating is configured to guide light from the lighting system at the base of the bottle to the upper edge of the coating film which is flush with a fill level of a liquid contained within the packaging, and wherein the coating is configured to guide the light within the liquid so that light is reflected from the surface of the liquid at the fill level causing the upper bulge to be lit more intensely than the intermediate bulge.

17. The packaging according to claim 16, wherein the bottle further comprises a lower bulge that is closer to the lighting system than the intermediate bulge, wherein the coating is configured to guide the light within the liquid so that the upper bulge and lower bulge are lit more intensely than the intermediate bulge.

* * * * *